US006964218B2

(12) United States Patent
Schafforz

(10) Patent No.: US 6,964,218 B2
(45) Date of Patent: Nov. 15, 2005

(54) METHOD OF AND APPARATUS FOR DIVIDING A WEB OF WRAPPING MATERIAL

(75) Inventor: Mathias Schafforz, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 435 days.

(21) Appl. No.: 09/944,217

(22) Filed: Sep. 4, 2001

(65) Prior Publication Data

US 2002/0029785 A1 Mar. 14, 2002

(30) Foreign Application Priority Data

Sep. 8, 2000 (DE) ..... 100 44 577

(51) Int. Cl.[7] ..... B23Q 15/22
(52) U.S. Cl. ..... 83/27; 83/73; 83/74; 83/358
(58) Field of Search ..... 83/27, 73, 105, 83/34–36, 72, 74, 75, 358; 226/18, 19, 20, 226/21, 22, 23, 24; 131/84.1

(56) References Cited

U.S. PATENT DOCUMENTS 4,412,505 A 11/1983 Hausler et al.
4,509,238 A 4/1985 Lee et al.
4,627,319 A 12/1986 Mattei et al.
4,721,119 A 1/1988 Ludszeweit et al.
4,889,138 A 12/1989 Heitmann et al.
4,893,640 A 1/1990 Heitmann et al.
4,924,885 A 5/1990 Heitmann et al.
4,945,926 A * 8/1990 Mattei et al. ..... 131/84.1
4,960,234 A 10/1990 Focke
5,072,741 A 12/1991 Heitmann
5,125,419 A 6/1992 Heitmann
5,488,887 A * 2/1996 Kitamura ..... 83/407

FOREIGN PATENT DOCUMENTS

DE 35 02 009 9/1985

* cited by examiner

*Primary Examiner*—Stephen Choi
(74) *Attorney, Agent, or Firm*—Venable LLP; Robert Kinberg; Catherine M. Voorhees

(57) ABSTRACT

A continuous web of cigarette paper or other wrapping material, particularly for smokers' products, is split by a pair of rotary knives into two strips which are fed to discrete strip processing units, such as wrapping units for rod-like tobacco fillers. If the width of the web and/or of one strip or both strips departs from a predetermined width, the web is shifted sideways and/or at least one of the strips is moved relative to the other strip to at least partially compensate for departures of monitored width from the predetermined width. This can be accomplished by changing the orientation of a frame for rollers which flank the web and/or by changing the level or levels of one or more rolls which advance the web by way of the strips.

29 Claims, 5 Drawing Sheets

1
120
31a
31
29
34
M
33
43
32
P
32a
2
20
20a
6
7
42
20b
9
11
8
20c
13
14
12
28
3b
10
3a
27a
27
26
4
26a
4a
3
4b
P

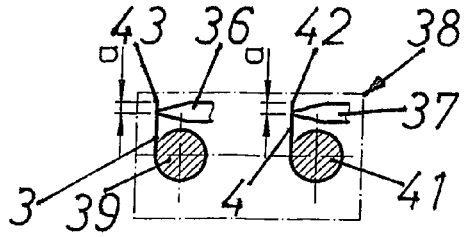
Fig.9
Fig.7
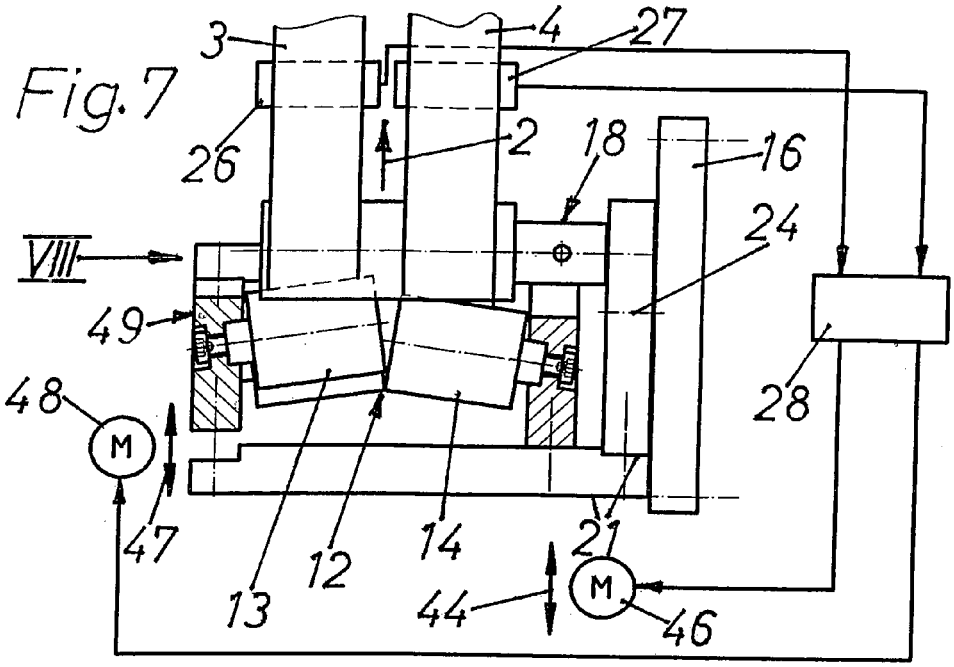
Fig.6
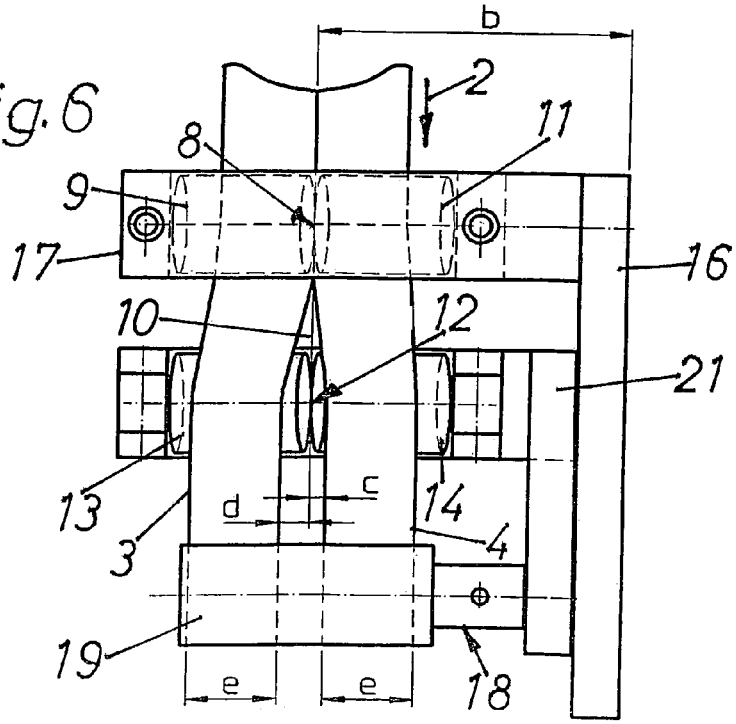

METHOD OF AND APPARATUS FOR DIVIDING A WEB OF WRAPPING MATERIAL

CROSS-REFERENCE TO RELATED CASES

This application claims the priority of the commonly owned copending German patent application Serial No. 100 44 577.2 filed Sep. 8, 2000. The disclosure of the above-identified German patent application, as well as that of each US and/or foreign patent and/or patent application identified in the specification of the present application, is incorporated herein by reference.

BACKGROUND OF THE INVENTION

The invention relates to improvements in methods of and in apparatus for manipulating running webs of paper or the like, and more particularly to improvements in methods of and in apparatus for dividing a running web of wrapping material, such as cigarette paper or other sheet-like or strip-shaped wrapping material in cigarette making, cigarette packing and analogous machines.

It is often necessary to split a running web of paper or the like into a plurality of (e.g., into two) identical strips. Such undertaking is a relatively simple procedure if the width of the web is always constant; however, problems can and do arise if the width of the web varies at times in an unpredictable manner in an apparatus or machine wherein the widths of the strips should be identical at all times or wherein the width of one of the strips should remain constant irrespective of variations in the width of a web which is to be severed or otherwise split into plural strips. Moreover, problems arise when a relatively thin web (such as a web of cigarette paper) is to be subdivided into plural strips without tearing, cracking, folding and at a high or very high speed such as is necessary or expected in a modern cigarette rod making machine, especially in a machine which is designed to simultaneously turn out several continuous cigarette rods each of which is ready to be subdivided into a series or file of successive cigarettes of unit length or multiple unit length.

In a so-called multiple-rod cigarette making machine, it is customary to split a running web of cigarette paper lengthwise into at least two discrete strips each of which is thereupon draped around a discrete rod-shaped filler of tobacco particles (e.g., shreds of tobacco leaf laminae). The web must be treated gently in order to avoid damage to the tubular wrappers of discrete cigarettes, to avoid misalignment of the strips in the wrapping mechanism, as well as to ensure identity of cigarettes regardless of whether they contain portions of the one or the other filler being turned out in a twin-rod cigarette maker. The situation is analogous in a machine which turns out filter rods of the type wherein a rod-like filler of filter material for tobacco smoke (such as cellulose acetate fibers) is confined in a strip of cigarette paper or other suitable wrapping material. The same holds true for packing machines wherein long series of arrayed groups of parallel plain or filter cigarettes, cigars or cigarillos are to be confined in converted blanks of paper, cardboard or other wrapping material and such blanks are obtained by subdividing running strips each of which is a part (such as one-half) of a running web of wrapping material. Splitting of webs of wrapping material is customary in packing machines which turn out so-called soft cigarette packs.

Presently known web splitting machines are disclosed, for example, in U.S. Pat. No. 4,960,234 (granted Oct. 2, 1990 to Focke for "APPARATUS FOR SEPARATING WEBS OF MATERIAL INTO (TWO) PART WEBS" and corresponding to European patent No. 0 309 818) and in U.S. Pat. No. 4,627,319 (granted Dec. 9, 1986 to Mattei et al. for "DEVICE FOR SUPPLYING WEBS OF WRAPPING MATERIAL TO A CIGARETTE MAKING MACHINE OF THE TWO ROD TYPE" and corresponding to German patent No. 35 02 009).

OBJECTS OF THE INVENTION

An object of the present invention is to provide a novel and improved method of dividing a running web of wrapping material or the like into plural elongated strips in such a way that the characteristics of the strips more closely resemble or approximate the desired characteristics than the characteristics of strips which are obtained in accordance with heretofore known methods.

Another object of the invention is to provide a novel and improved method of counteracting the tendency of a web splitting apparatus to turn out strips having different characteristics, such as different widths.

A further object of the invention is to provide a novel and improved method of regulating the advancement of plural strips of wrapping material in a multiple-rod cigarette making, filter rod making or other wrapping machine.

An additional object of this invention is to provide a method which renders it possible to preselect the characteristics of strips which are yielded by a running web with a degree of accuracy greater and for intervals of time longer than in accordance with heretofore known methods.

Still another object of the instant invention is to provide a method of the above outlined character which is less dependent upon the quality of the web and/or upon the circumstances in a strip processing machine or apparatus than heretofore known methods.

A further object of the invention is to provide a novel and improved apparatus for the practice of the above outlined method.

Another object of the invention is to provide a novel and improved apparatus for feeding strips of wrapping material to machines which are designed for simultaneous production of plural lines or series of products of the tobacco processing industry.

An additional object of the present invention is to provide a novel and improved wrapping mechanism for use in a multiple-rod cigarette making machine, in a multiple-filter rod making machine or in a multiple-row cigarette packing machine.

Still another object of this invention is to provide a novel and improved apparatus which can reliably, accurately and automatically compensate for departures of a multiple-unit width running web of cigarette paper or other wrapping material from a prescribed or desired or required width.

A further object of the invention is to provide an apparatus of the just outlined character which can be readily installed as a superior substitute for conventional web splitting and processing apparatus.

Another object of the invention is to provide the above outlined apparatus with novel and improved means for guiding a running web and/or the contituents of a split web of cigarette paper or the like prior and/or subsequent to splitting of the web into a plurality of strips.

An additional object of the invention is to provide novel and improved means for monitoring a one-piece web or a split web in its path or paths in a cigarette rod making or an analogous machine, in a cigarette pack making machine, or in analogous machines.

Still another object of this invention is to provide novel and improved combinations of two or more web and/or strip advancing, guiding and redirecting elements for use in the above outlined apparatus and machines.

SUMMARY OF THE INVENTION

One feature of the present invention resides in the provision of a method of dividing an elongated web having a variable width (e.g., a width which, as a rule, is constant but is apt to vary from time to time to a different extent and/or for shorter or longer intervals of time) into a plurality of elongated strips. The improved method comprises the steps of advancing the web lengthwise in a predetermined direction along a predetermined path (e.g., along a generally horizontal path), subdividing the web into a plurality of strips including cutting the advancing web in at least one severing plane, monitoring the widths of the strips and generating signals denoting the monitored widths, processing the signals (such processing can involve a determination of the width of the web by obtaining a sum of the signals denoting the widths of individual strips and/or a determination whether or not the monitored width(s) of one or more strips departs or depart from a preselected width), and shifting the web, the severing plane and/or at least one of the strips sideways when the processing step indicates departure of at least one monitored width from a predetermined width.

In many instances, it suffices if the subdividing step includes splitting the web into two strips; the signal processing step of such method can include comparing the signals denoting the widths of the two strips. This renders it possible to ascertain whether or not the width of the web matches the desired or prescribed width as well as whether or not the width of one of the strips matches or is sufficiently close to the width of the other strip. If the web is to be split into two strips, the predetermined width is or can be half the width of the web. The shifting step can include moving the web sideways in a direction to reduce the width of the strip having a width exceeding half the width of the web (i.e., the width of the other strip).

The shifting step can also include turning the advancing web about an axis which is located in or at least close to the at least one severing plane.

The method can further comprise the step of advancing the strips along second paths; the aforementioned web advancing step can form part of the just mentioned strip advancing step because a pull exerted upon the strip is transmitted to the web at the severing or subdividing station. The strip advancing step can include establishing one or more variable spacings or gaps between the second paths (the number of such gaps depends upon the overall number of the strips). The establishment of one or more variable spacings can include changing the mutual inclinations of two neighboring successive increments of each of the second paths. The second paths can slope downwardly from the at least one severing plane as seen transversely of the predetermined direction.

The monitoring step is or can be carried out in the second paths.

If the subdividing step includes splitting the web into two strips, the shifting step can include shifting at least one of the thus obtained two strips sideways, e.g., away from the severing plane. Such method can further include the step of (directly or indirectly) monitoring the width of the web, and the subdividing step of such method can further include shifting at least one of the strips sideways until the width of the at least one strip assumes a predetermined value which might but need not be a value denoting the width of the other strip. The step of shifting at least one of the strips can include shifting only one of the strips sideways relative to the other strip.

Another feature of the present invention resides in the provision of an apparatus for dividing an elongated web having a variable width into at least two strips. The improved apparatus comprises means for advancing the web lengthwise in a predetermined direction along a predetermined path, means for subdividing the web into at least two strips including a severing unit which is arranged to split the web in a severing plane, means for monitoring the widths of the strips and for generating first signals denoting the monitored widths, means for processing the first signals and for generating second signals when the width of at least one of the at least two strips deviates from a predetermined width, and adjusting means including means for shifting the web and/or at least one of the strips and/or the subdividing means transversely of the predetermined direction in response to the second signals.

In accordance with one presently preferred embodiment of the improved apparatus, the adjusting means includes only means for shifting the web transversely of the predetermined direction.

The shifting means can include first and second rollers which flank the web upstream of the severing unit and are rotatable about at least substantially parallel axes, and means for jointly turning the rollers about an axis which is at least substantially normal to the axes of such rollers.

The means for advancing the web can include a pair of rolls each of which engages a different one of the at least two strips; these rolls are rotatable about axes which are inclined relative to each other. The rolls are adjacent one side of the predetermined path, and the web advancing means can further include a second pair of rolls each of which engages a different one of the at least two strips. The rolls of the second pair are adjacent the other side of the path and have axes which are inclined relative to each other. In such apparatus, the monitoring means is or can be disposed downstream of at least one of the two pairs of rolls (as seen in the predetermined direction), and the apparatus can further comprise means for changing the level of at least one pair of rolls, preferably that pair of rolls which is disposed beneath the respective portion of the predetermined path. The just discussed embodiment of the improved apparatus can further comprise a deflecting roller which contacts the strips downstream of the at least one pair of rolls, and the level changing means can include an elevator which is common to the at least one pair of rolls and the deflecting roller. The at least one pair of rolls and the deflecting roller are or can be disposed at opposite sides of the predetermined path, and such apparatus can further include a housing having a guide (such as a dovetailed guide) for the elevator; the latter can comprise a platform which supports the deflecting roller and the at least one pair of rolls and is movable along the guide. The level changing means can further comprise a feed screw or another suitable device which is operable to move the platform along the guide. Suitable fastener means can be provided to releasably secure the platform to the housing.

The rolls of that pair of rolls which is disposed at a level below the predetermined path can serve to change the level of at least one of the strips in response to the second signals furnished by the signal processing means; such rolls can be said to form part of the shifting means.

If the signal processing means includes means for generating second signals which denote the combined width of the strips, the means for changing the level of the at least one strip is or can be responsive to such signals. The just discussed processing means can further include means for generating additional signals which denote the widths of the strips, and the strip shifting means of the apparatus utilizing such signal processing means preferably further includes means for changing the level of the other of the strips in response to the additional signals if and when generated by the signal processing means. The signal processing means can include one or more suitable electronic circuits having input means receiving (first) signals from a plurality of mechanical, optical, optoelectronic and/or other suitable sensors adjacent the path of the web and/or the paths of the strips.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

BRIEF DESCRIPTION OF THE DRAWINGS

FIG. 6 is a fragmentary plan view similar to that of FIG. 2 but with the guide means for the web and for one of the strips in a fixed position;

FIG. 7 is a view similar to that of FIG. 3 but showing certain additional parts of the modified apparatus embodying the structure of FIG. 6;

FIG. 9 is a fragmentary sectional view of the dual wrapping mechanism which is utilized in the apparatus embodying the structure shown in FIGS. 6 to 8.

DESCRIPTION OF PREFERRED EMBODIMENTS

Figure 1:
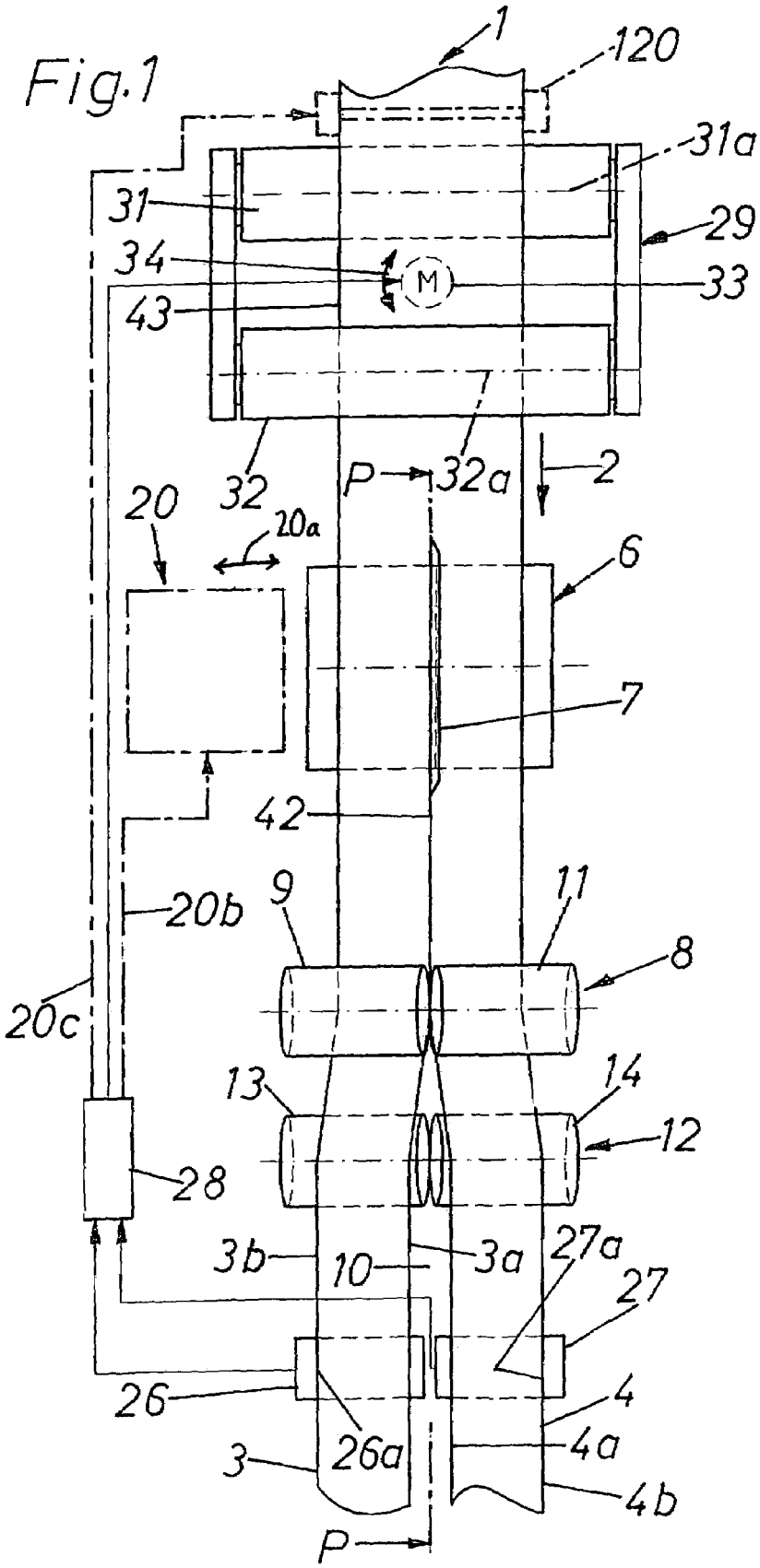
FIG. 1 is a fragmentary plan view of a web splitting and wrapping apparatus which embodies one form of the present invention and is utilized in a multiple-rod cigarette making or an analogous machine.

FIG. 1 shows a portion of an apparatus which serves to divide a running web 1 of sheet material (such as a cigarette paper web, a web of wrapping material for arrays of cigarettes or other rod-shaped or otherwise configurated smokers' products or the like) into two elongated strips 3 and 4. As a rule, the width of the web 1 is constant and this web is advanced lengthwise in the direction indicated by an arrow 2. For example, the web 1 can be supplied by a bobbin or reel (not shown) in a so-called twin cigarette rod machine. Machines of such type are described and shown, for example, in U.S. Pat. No. 4,889,138 (granted Dec. 26, 1989 to Heitmann et al. for "METHOD OF AND APPARATUS FOR SIMULTANEOUSLY MAKING PLURAL TOBACCO STREAMS"), U.S. Pat. No. 4,893,640 (granted Jan. 16, 1990 to Heitmann et al. for "MULTIPLE-ROD CIGARETTE MAKING MACHINE"), U.S. Pat. No. 4,924,885 (granted May 15, 1990 to Heitmann et al. for "METHOD OF AND APPARATUS FOR BUILDING, GUIDING AND TRIMMING STREAMS OF FIBROUS MATERIAL"), U.S. Pat. No. 5,009,238 (granted Apr. 23, 1991 to Heitmann for "APPARATUS FOR SUPPLYING FIBROUS MATERIAL TO MACHINES FOR SIMULTANEOUSLY PRODUCING A PLURALITY OF CIGARETTE RODS"), U.S. Pat. No. 5,072,741 (granted Dec. 17, 1991 to Heitmann for "METHOD OF AND APPARATUS FOR MAKING PLURAL TOBACCO FILLER STREAMS") and 5,125,419 (granted Jun. 30, 1992 to Heitmann for "METHOD OF AND APPARATUS FOR MAKING PLURAL TOBACCO STREAMS" ).

The web 1 is drawn off the reel and is advanced along an elongated path (which can but need not be largely horizontal or nearly horizontal) in the direction indicated by the arrow 2. A portion of such path extends through a severing or splitting or subdividing station where a severing unit 6 having two rotary disc-shaped knives 7 (only the upper knife 7 is shown in FIG. 1) serves to divide or split the web 1 into the two halves or strips 3 and 4 (hereinafter called strips to distinguish from the web 1). The other knife 7 is located below the path for the running web 1 and its circular peripheral cutting edge cooperates with that of the illustrated knife 7 to convert the web 1 into the two strips 3, 4 preferably or desirably having equal widths e (see FIG. 6). Each of these strips is converted into a tubular envelope or wrapper for a continuous rod-like filler of tobacco (see the fillers 39 and 41 shown in FIG. 9), into an envelope of a cigarette pack (especially a so-called soft pack), into a tubular envelope for a rod-like filler consisting of filter material for tobacco smoke, or into any other suitable envelope or container for a continuous elongated commodity (such as the aforementioned tobacco fillers 39 and 41) or for a series of successive discrete commodities. The mechanisms which convert the two discrete strips 3, 4 into tubular, box-shaped or other envelopes or the like can but need not be identical.

The path for the web 1 and its strips 3, 4 extends beyond the severing unit 6 through a spreading station which accommodates a first (upstream) strip advancing unit 8 and a second (downstream) strip advancing unit 12. The unit 8 includes a pair of elongated rolls 9, 11 which are or can be mirror images of each other with reference to a vertical symmetry plane or severing plane P—P for the cutting edge of the rotary knife 7 shown in FIG. 1. The advancing unit 12 is located downstream of the unit 8 and also includes a pair of elongated rolls 13, 14 which are mirror images of each other with reference to the aforementioned severing plane P—P for the cutting edge of the knife 7 shown in FIG. 1. The rolls 9, 11 are installed at a level above, and the rolls 13, 14 are installed at a level below the respective portions of the path for the strips 3 and 4. The axes of the rolls 13, 14 are inclined relative to each other, the same as the axes of the rolls 9, 11. Furthermore, the axes of the rolls 9, 11 slope downwardly from the plane P—P toward the outer marginal portions 3*b*, 4*b* of the respective strips 3 and 4. The same applies for the axes of the rolls 13 and 14. At least those portions of the rolls 9,11 and 13,14 which are remotest from the plane P—P extend beyond the respective outer marginal portions 3*b*, 4*b*.

Figure 3:
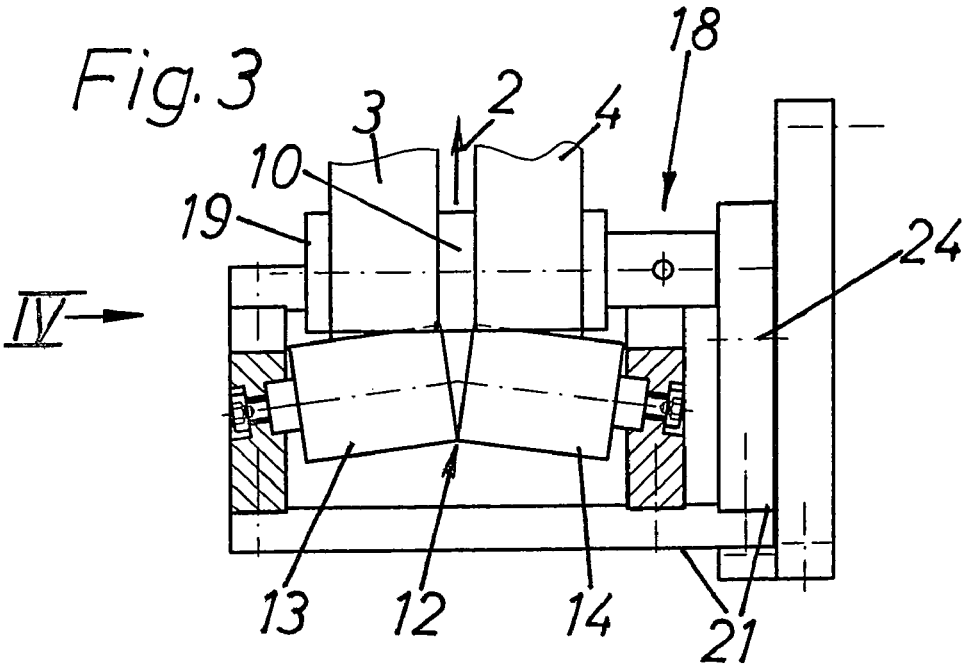
FIG. 3 is a transverse sectional view substantially as seen in the direction of arrows from the line III—III in FIG. 2.
Figure 2:
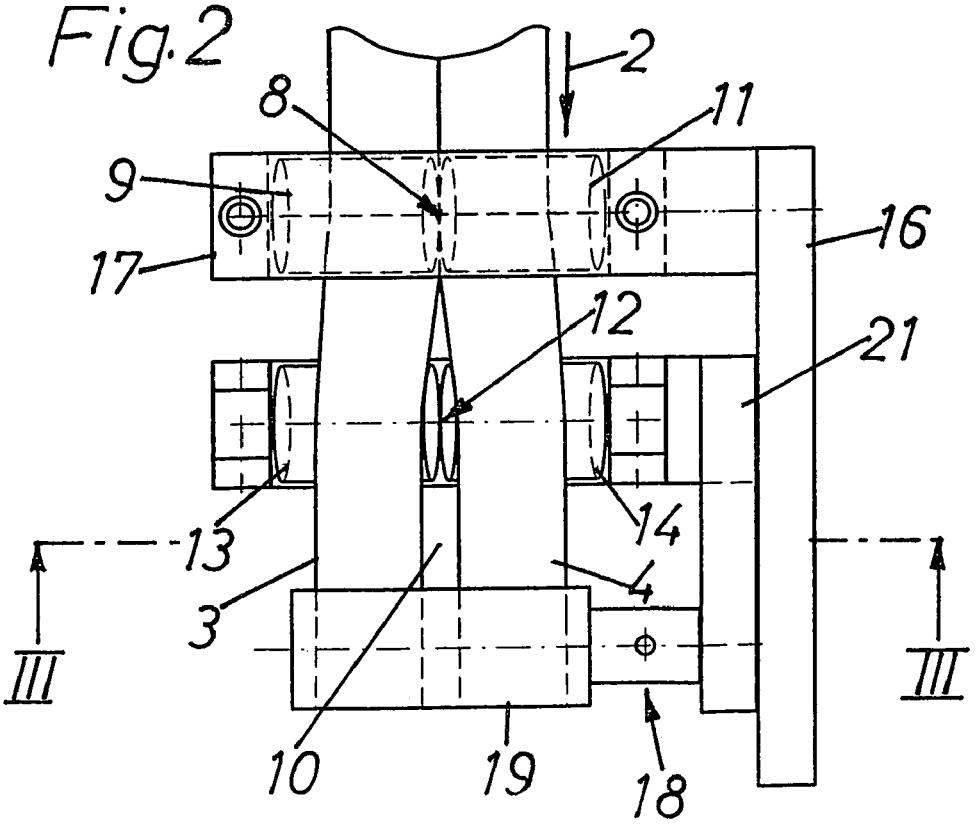
FIG. 2 illustrates a portion of the apparatus which is shown in FIG. 1 and certain additional parts of such apparatus.
Figure 4:
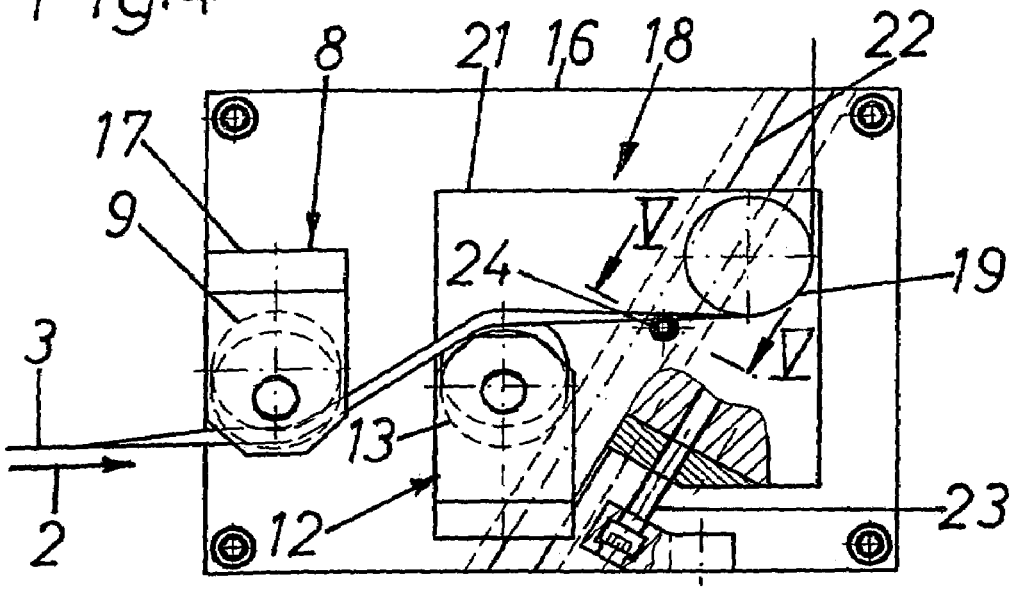
FIG. 4 is a fragmentary side elevational view substantially as seen in the direction of arrow IV in FIG. 3.

The just described mounting of the advancing units 8, 12 respectively including the pairs of rolls 9, 11 and 13, 14 causes the strips 3 and 4 to move apart, i.e., their freshly obtained inner marginal portions or edges 3*a* and 4*a* move away from each other and they are trained over a combined entraining and deflecting roller 19 (see FIGS. 3 and 4) which directs successive increments of the strips 3, 4 to the strip processing stations (e.g., to stations of the type shown in FIG. 9). The initially increasing and thereupon constant width of the clearance or gap 10 between the freshly obtained inner marginal portions or edges 3*a*, 4*a* of the strips 3 and 4 can be best seen in FIGS. 1 to 3.

Figure 5:
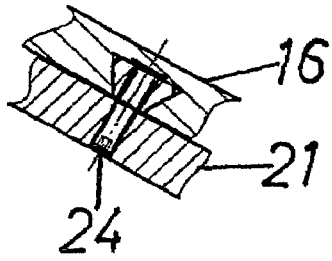
FIG. 5 is a fragmentary sectional view substantially as seen in the direction of arrows from the line V—V in FIG. 4.

The rolls 9, 11 of the unit 8 are mounted on a bearing carrier 17 borne by a stationary sidewall 16 of the housing of the improved apparatus. The rolls 13, 14 of the lower unit 12 form part of an elevator 18 and cooperate with the deflecting roller 19 to define a substantially horizonal portion of the path for advancement of the strips 3 and 4 (see particularly FIG. 4) along a receiving platform 21 (see FIGS. 2 to 4). The platform 21 is movable along a dovetailed guide 22 by a feed screw 23 to advance along the aforementioned sidewall 16. The means for releasably securing the platform 21 (and hence the unit 12) to the sidewall 16 at a selected level comprises a bolt-shaped fastener 24 (shown in FIGS. 4–5 and indicated in FIG. 3). By changing the level of the elevator 18 for the lower unit 12 (rolls 13 and 14), i.e., by changing the mutual inclination of the strips 3 and 4, one can change the width of the gap 10 in the region between the units 8 and 12, namely the distance between the freshly formed confronting edges 3*a*, 4*a* of the strips 3 and 4.

The unit 12 is followed (as seen in the direction of the arrow 2) by two monitoring devices or sensors 26, 27 which are installed at a level beneath the adjacent portion of the path for the strips 3 and 4 and serve to generate first signals respectively denoting the widths of the strips 3 and 4 (see FIG. 1). Each of the sensors 26, 27 can constitute a compact photoelectric cell which operates with one or more laser beams and can be of the type distributed by the Firm Keyence under the designation Modellreihe LX2-13W. It is clear that such specific sensors constitute but one form of monitoring means which can be utilized to ascertain the widths of successive increments of the running strips 3, 4 with a desired degree of accuracy. For example, one can resort to sensors of the type similar to those disclosed in the aforementioned U.S. Pat. No. 4,627,319 to Mattei et al. or similar to those disclosed in the aforementioned U.S. Pat. No. 4,960,234 to Focke.

The sensors 26, 27 have outputs serving to transmit the respective first signals to the corresponding inputs of a control unit 28 which serves to process the first signals (e.g., which compares the first signals) and transmits appropriate second signals to an adjusting unit 29 when the width of one of the strips 3, 4 departs from that of the other of these strips. The adjusting unit 29 includes two elongated parallel rollers 31, 32 which are respectively located below and above the adjacent path portion for the web 1 upstream of the knives 7. The entire adjusting unit 29 is turnable about an axis which is normal to the adjacent portion of the aforementioned path and to the axes 31*a*, 32*a* of the rollers 31, 32 and is located in or close to the vertical symmetry plane or severing plane P—P.

The means 33 for turning the adjusting unit 29 about the axis which is normal to the axes 31*a*, 32*a* includes a reversible electric motor M which can turn the unit 29 in directions indicated by a double-headed arrow 34. Adjusting units 29 of the type shown in the upper part of FIG. 1 are distributed by the Firm FIFE GmbH, Kelkheim/Taunus, Federal Republic Germany. Such units constitute but one of numerous adjusting means which can be put to use to move the web 1 sideways so that, when necessary, the central longitudinal portion of the web 1 is returned into the symmetry plane or severing plane P—P ahead or upstream of the severing unit 6 and at a sufficient distance from the knives 7 to reliably ensure that these knives will halve the web 1 into two strips 3, 4 having identical widths.

The operation of the apparatus, certain details of which are shown in FIGS. 1 to 5, is as follows:

To start the apparatus, the aforementioned bobbin or reel is set in rotary motion to pay out the web 1 lengthwise in the direction of the arrow 2, and the position of the severing apparatus 6 is thereupon selected and fixed to ensure that the split or severed web 1 yields two strips 3, 4 of identical widths e. Such situation should thereupon prevail or should be restored with little or no delay, even if the width of the web 1 is not constant and/or if the web migrates sideways with respect to the symmetry plane or severing plane P—P.

If the web 1 happens to move sideways not later than at the severing station for the unit 6, the width of one of the strips 3, 4 increases with a simultaneous reduction of the width of the other of these strips. Such deviations from identical widths e are detected by the sensors 26, 27 which transmit appropriate (first) signals to the control unit 28. The unit 28 starts the motor M of the means 33 for turning the adjusting unit 29 in a sense to move the assembly including the rollers 31, 32 in one of the directions indicated by the double-headed arrow 34. This causes the web 1 to move sideways until the width of the strip 3 again matches that of the strip 4. The control unit 28 then initiates a stoppage of the motor M so that the turning of the adjusting unit 29 for the continuously advancing web 1 about the axis defined by the motor M comes to a halt.

Similar results can be obtained if the adjusting unit 28 for the position of the web 1 ahead of the knives 7 is replaced with an adjusting unit 20 (indicated in FIG. 1 by phantom lines) which moves the severing unit 6 in one of the directions indicated by a double-headed arrow 20*a* when the output 28*a* of the control unit 28 transmits (at 20*b*) a (second) signal to the adjusting unit 20. The adjusting unit 29 is preferred at this time.

It is also possible to replace the adjusting units 20, 29 with an adjusting unit 120 (indicated in FIG. 1 by phantom lines) which is designed to positively move the web 1 sideways (to the right or to the left) in response to appropriate (second) signals from the output 20*c* of the control unit 28 (or from a discrete second control unit).

The monitoring devices 26, 27 can be designed to establish stationary lateral abutments or stops 26*a*, 27*a* for the respective strips 3, 4 and to measure the widths of the respective strips in directions transversely of the running strips and away from such abutments 26*a*, 27*a*. The just described apparatus can be put to use if the material of the strips 3, 4 is capable of standing at least some deforming stresses, i.e., if the abutments 26*a*, 27*a* are not likely to damage or deface the adjacent marginal portions of the strips 3 and 4.

In accordance with a further modification, the width of the gap 10 at the sensors 26, 27 is held at a constant value and the sensors measure the widths of the respective strips 3, 4 in directions away from such gap, i.e., at right angles to the direction indicated by the arrow 2.

It is advisable to conform the width of the gap 10 to the distance between the mechanisms (such as wrapping mechanisms) which are employed to convert the strips 3, 4 into tubular envelopes for rod-like tobacco fillers (reference should be had again to the fillers 39 and 41 shown in FIG. 9), into envelopes for (preferably) soft cigarette packs or the like. This will be explained in greater detail hereinafter.

If the web 1 consists of cigarette paper or a similar rather readily deformable material, it is advisable to resort to an adjusting unit (such as 29) which need not bear against the edge faces of the web 1, and/or to employ contactless sensors which need not contact or need not bear upon the edge faces of the strips 3 and 4. This greatly reduces the likelihood of undesirable deformation and/or other damage to the strips.

Since the cutting edges of the knives 7 are located in the symmetry plane or severing plane P—P, the locations of those edges 3*a*, 4*a* of the strips 3, 4 which are adjacent each other on their way from the severing unit 6 toward the respective strip processing stations are always known and can be resorted to as reference edges or edge faces. In other words, eventual changes of the width of the web 1 can affect only the locations of the outer edges 3*b*, 4*b* of the strips moving away from the web severing station.

Figure 8:
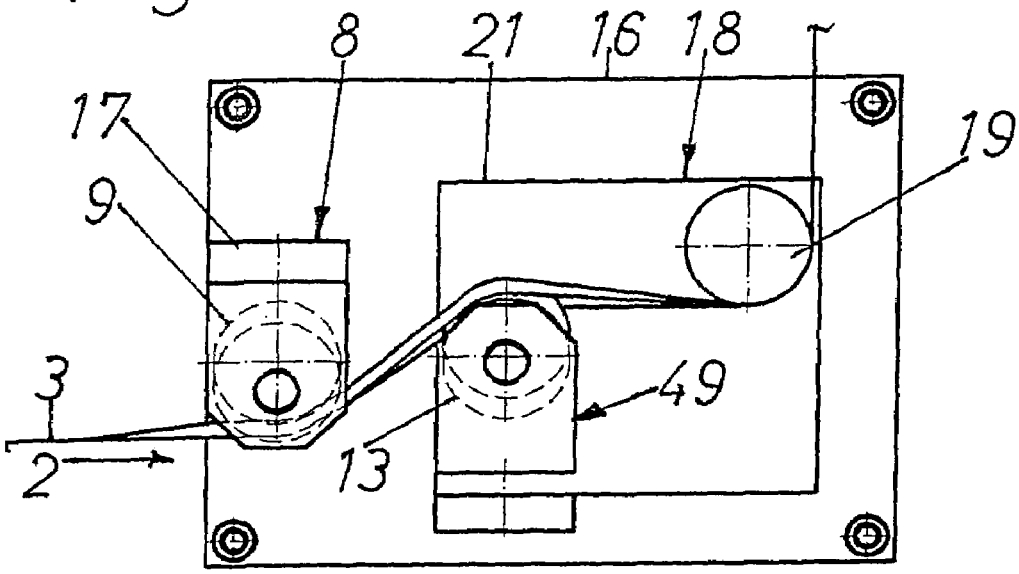
FIG. 8 is a fragmentary side elevational view as seen in the direction of arrow VIII shown in FIG. 7.

The apparatus which embodies the structure shown in FIGS. 7 to 9 can be utilized with advantage in cigarette rod making machines of the type disclosed in the aforementioned U.S. Pat. Nos. 4,889,138, 4,893,640, 4,924,885, 5,009,238, 5,072,741 and 5,125,419, namely in machines wherein two rod-shaped tobacco fillers 39, 41 (see FIG. 9) are simultaneously draped into two continuous strips 3 and 4. Such strips are obtained by halving a single web 1 of cigarette paper. The left-hand edge portion 43 of the left-hand strip 3 shown in FIG. 9 is the left-hand edge portion of the web 1 shown in FIG. 1, and the left-hand edge portion 42 of the strip 4 shown in FIG. 9 is the edge portion (4*a*) developing as a result of halving of the web 1 by the knives 7 of the severing unit 6 shown in FIG. 1.

FIG. 9 further shows two adhesive applying nozzles 36, 37 having orifices respectively adjacent one side of the edge portion 43 and one side of the edge portion 42. These orifices must be positioned in such a way that they discharge single or multiple layers of a suitable adhesive at identical distances from the free ends (edge faces) of the respective edge portions 43, 42. This ensures that the seams formed by the edge portions 43, 42 with the adjacent portions of the fully converted (tubular) strips 3, 4 will be identical, i.e., that the two continuous cigarette rods issuing from the machine including the apparatus which embodies the structure shown in FIGS. 7 to 9 will be identical. Such structure is incorporated in and/or associated with a wrapping mechanism 38 corresponding to that shown at 27 in FIG. 1 of the aforementioned U.S. Pat. No. 4,893,640 to Heitmann et al. Wrapping mechanisms of the type shown in FIG. 9 are asymmetrical mechanisms. The identical distances between the locations of adhesive application by the orifices of the nozzles 36, 37 and the free ends of the respective edge portions 43, 42 are shown at a.

The cigarette making machine embodying the wrapping apparatus 38 of FIG. 9 also includes certain parts shown in FIGS. 1 to 8, i.e., also the sensors 26, 27 or their equivalents, the control (signal processing) unit 28, and the adjusting unit 29 or its equivalent. Therefore, the control unit 28 can continuously receive and process information including the combined width 2*e* of the strips 3 and 4, i.e., the width of the web 1 prior to splitting at the station accommodating the severing unit 6. The width of the web 1 is likely or even bound to vary, either continuously or sporadically, due to tolerances. The wrapping unit or apparatus 38 is installed in such a way that the fulcrum for the adjusting unit 29 (i.e., the axis about which the motor M can turn the rollers 31, 32 in directions indicated by the double-headed arrow 34) is located in the plane P—P, i.e., in the plane in which the running web 1 is being severed by the knives 7. As already mentioned hereinbefore, such axis is normal to the axes 31*a*, 32*a* of the rollers 31, 32. The plane P—P is located at a distance b (FIG. 6) from the exposed side of the wall 16.

In accordance with a feature of the present invention, the fact that the wrapping mechanism or apparatus 38 is asymmetric (as far as the positions of its adhesive supplying nozzles 36, 37 are concerned), and the fact that the distance b is constant are taken advantage of in that, in order to vary the width of the clearance or gap 10, it is only necessary to move the strip 3 sideways relative to the strip 4 (i.e., to vary the distance d shown in FIG. 6) in order to ensure that the application of adhesive by the nozzle 36 to the edge portion 43 takes place at the same distance from the free edge of this edge portion as the application of adhesive by the nozzle 37 from the free edge of the edge portion 42. In other words, a compensation for changes in the width of the web 1 can take place by the simple expedient of leaving the position of the strip 4 unchanged (i.e., by leaving unchanged the distance c between the edge of the edge face 42 and the severing plane P—P) and by merely changing the distance d between the plane P—P and the strip 3.

The reference character 46 denotes in FIG. 7 a motor or another suitable prime mover which receives signals from an output of the control unit 28, when necessary, to select (see the arrow 44) an optimum distance c for the strip 4 from the plane P—P. Actually, the motor 46 serves to operate the elevator 18 which entails a change of the distance c by way of the unit 12. The distance c of the strip 4 from the plane P—P is variable by changing the level (see the arrow 47 shown in FIG. 9) of the roll 13 relative to the roll 14 by way of a servomotor 48 which controls an elevator (level controlling or changing device) 49.

An advantage of the feature that the platform 21 supports the mutually inclined advancing rolls 13, 14 of the second pair 12 as well as the horizontal roller 19, and that this platform is movable along the dovetailed (or analogous) guide 22, is that those portions of the strips 3, 4 which advance along the roller 19 are invariably located in a plane that is parallel to the (normally horizontal) axis of he roller 19. The inclination of the illustrated feed screw 23 preferably matches that of the guide 22.

Apparatus embodying the present invention can supply strips of wrapping material to pairs of wrapping mechanisms of the type disclosed, for example, in U.S. Pat. No. 4,412,505 granted Nov. 1, 1983 to Häusler et al. for "APPARATUS FOR APPLYING ATOMIZED LIQUID TO A RUNNING LAYER OF FILAMENTARY MATERIAL OR THE LIKE", or to pairs of wrapping mechanisms of the type disclosed, for example, in U.S. Pat. No. 4,721,119 granted Jan. 26, 1988 to Ludszeweit et al. for "ROD MAKING MACHINE WITH MEANS FOR ADJUSTING THE POSITION OF WRAPPING MATERIAL".

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of processing multiple-width webs of wrapping material or the like and, therefore, such adaptations should and are intended to be comprehended within the meaning and range of equivalence of the appended claims.

What is claimed is:

1. A method of dividing an elongated web having a variable width into a plurality of elongated strips, comprising the steps of:

advancing the web lengthwise in a predetermined direction along a predetermined path;

subdividing the web into a plurality of strips, including cutting the advancing web in at least one severing plane;

monitoring the widths of the strips and generating signals denoting the monitored widths;

processing said signals; and shifting at least one of the web and the severing plane sideways when the processing step indicates departure of at least one monitored width from a predetermined width.

2. The method of claim 1, wherein said subdividing step includes splitting the web into two strips.

3. The method of claim 2, wherein said processing step includes comparing the signals denoting the widths of said two strips.

4. The method of claim 3, wherein said shifting step includes turning the advancing web about an axis which is located in said at least one severing plane.

5. The method of claim 1, wherein said shifting step includes moving the web sideways in a direction to reduce the width of the strip having a width exceeding half the width of the web.

6. The method of claim 1, further comprising the step of advancing the strips along second paths.

7. The method of claim 6, wherein said step of advancing the strip includes establishing a variable spacing between said second paths.

8. The method of claim 7, wherein said monitoring step is carried out in said second paths.

9. The method of claim 7, wherein the establishment of said variable spacing includes changing the mutual inclinations of two neighboring successive increments of each of said second paths.

10. The method of claim 9, wherein said second paths slope downwardly from said at least one severing plane as seen transversely of said predetermined direction.

11. The method of claim 7, wherein said step of establishing a variable spacing includes shifting at least one of the strips sideways.

12. The method of claim 11, wherein said step of shifting at least one of the strips includes shifting only one of said strips sideways relative to the other of said strips.

13. Apparatus for dividing an elongated web having a variable width into two strips, comprising:

means for advancing the web lengthwise in a predetermined direction along a predetermined path;

means for subdividing the web into two strips including a severing unit arranged to split the web in a severing plane;

means for monitoring the widths of each of the strips and for generating first signals denoting the monitored widths;

means for processing said first signals and for generating second signals when the widths of the strips deviate from each other; and adjusting means including means for shifting at least one of the web and the subdividing means transversely of said direction in response to said second signals.

14. The apparatus of claim 13, wherein said adjusting means includes only means for shifting the web of transversely of said direction.

15. the apparatus of claim 13, wherein said shifting means includes first and second rollers flanking the web upstream of said severing unit and rotatable about at least substantially parallel axes, and means for jointly turning said rollers about an axis at least substantially normal to said at least substantially parallel axes.

16. The apparatus of claim 13, wherein said advancing means includes a first pair of rolls each engaging a different one of the strips, said first pair of rolls being rotatable about axes which are inclined relative to each other.

17. The apparatus of claim 16, wherein said first pair of rolls are adjacent one side of said path and said advancing means further includes a second pair of rolls, each of the second pair of rolls engaging a different one of the strips, the rolls of said second pair being adjacent the other side of said path and having axes which are inclined relative to each other.

18. The apparatus of claim 17, wherein said monitoring means is disposed downstream of at least one of said first and second pairs of rolls as seen in said predetermined direction.

19. The apparatus of claim 17, further comprising means for changing the level of at least one of said first and second pairs of rolls.

20. the apparatus of claim 19, wherein at least one of said first and second pair of rolls is disposed beneath the respective portion of said predetermined path.

21. The apparatus of claim 20, further comprising a deflecting roller contacting the strips downstream of said at least one pair of rolls, said level changing means including an elevator common to said at least one pair of rolls and said deflecting roller.

22. The apparatus of claim 21, wherein said at least one pair of rolls and said deflecting roller are disposed at opposite sides of said path.

23. The apparatus of claim 21, further comprising a housing having a guide for said elevator.

24. The apparatus of claim 23, wherein said elevator comprises a platform supporting said deflecting roller and said at least one pair of rolls and being movable along said guide.

25. The apparatus of claim 24, wherein said level changing means further comprises a feed screw operable to move said platform along said guide and fastener means releasably securing said platform to said housing.

26. The apparatus of claim 24, wherein said guide is a dovetailed guide.

27. The apparatus of claim 16, wherein said first rolls are disposed at a level below the respective portion of said predetermined path, the apparatus further comprising means for changing the level of at least one of said first rolls.

28. The apparatus of claim 27, wherein said processing means includes means for generating second signals denoting the combined width of the strips and said means for changing the level of the at least one roll is responsive to said second signals.

29. The apparatus of claim 28, wherein said processing means further comprises means for generating additional signals denoting the widths of the strips and the strip shifting means further includes means for changing the level of the other of the rolls in response to said additional signals.

* * * * *